United States Patent [19]

Okolischan

[11] 4,186,531

[45] Feb. 5, 1980

[54] FASCIA-PROTECTING DRIP-DIVERTING DEVICE

[76] Inventor: Anton Okolischan, 9475 Trillium Dr., Crestwood, Mo. 63126

[21] Appl. No.: 910,369

[22] Filed: May 30, 1978

[51] Int. Cl.[2] ..... F04D 13/00

[52] U.S. Cl. ..... 52/11; 52/58; 52/95

[58] Field of Search ..... 52/11, 16, 58, 288, 52/94, 95, 96

[56] References Cited

U.S. PATENT DOCUMENTS

| | | | |
|---|---|---|---|
| 2,421,978 | 6/1947 | Andrews | 52/11 |
| 2,857,861 | 10/1958 | Trostle | 52/94 |
| 4,109,428 | 8/1978 | Aarons | 52/95 X |

*Primary Examiner*—Carl D. Friedman

*Attorney, Agent, or Firm*—Rogers, Eilers & Howell

[57] ABSTRACT

A fascia-protecting drip-diverting device has an upper portion which is thin enough to be telescoped upwardly into the narrow space between a fascia and a gutter which is disposed immediately adjacent that fascia, has a lower portion which is thicker, stiffer and stronger than said upper portion to enable it to withstand the forces which must be applied to that fascia-protecting drip-diverting device to cause that upper portion to telescope upwardly between that fascia and that gutter, has a stop which limits the extent to which that upper portion can be telescoped between that fascia and that gutter, and has flanges at the side edges thereof which displace those side edges outwardly away from the fascia to keep laterally-moving drips from reaching that fascia, and has the bottom thereof displaced below the level of the bottom of the fascia to cause drips to move downwardly below the level of, and then fall away from, the bottom of the fascia without engaging that fascia.

16 Claims, 8 Drawing Figures

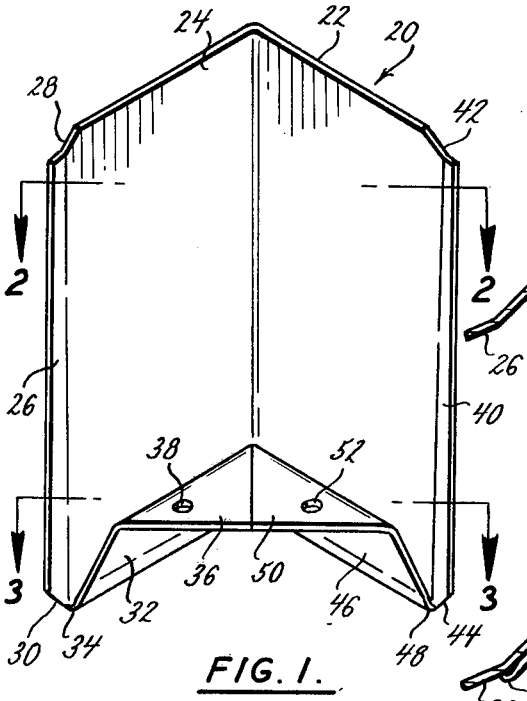
FIG. 1.
FIG. 2.
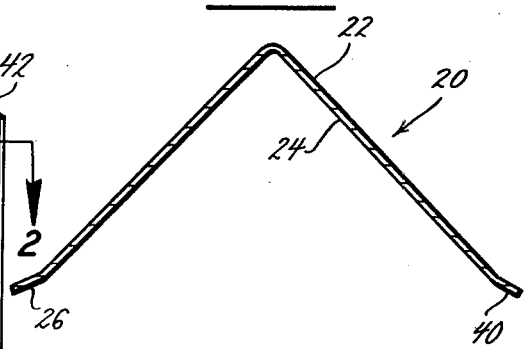
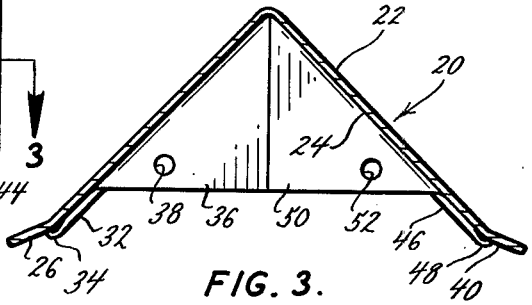
FIG. 3.
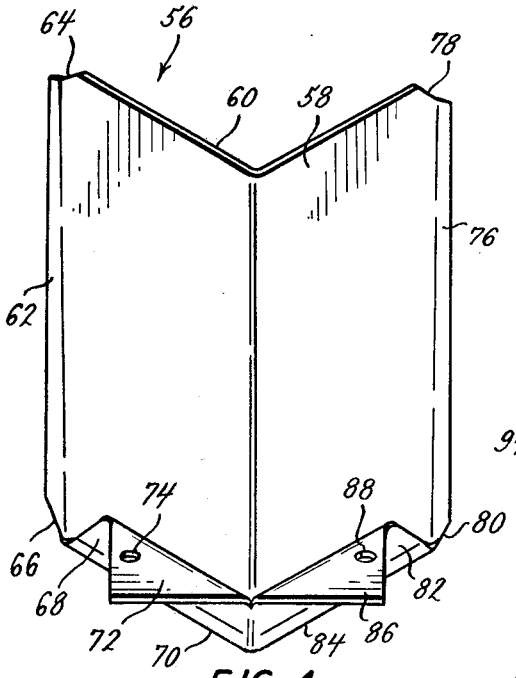
FIG. 4.
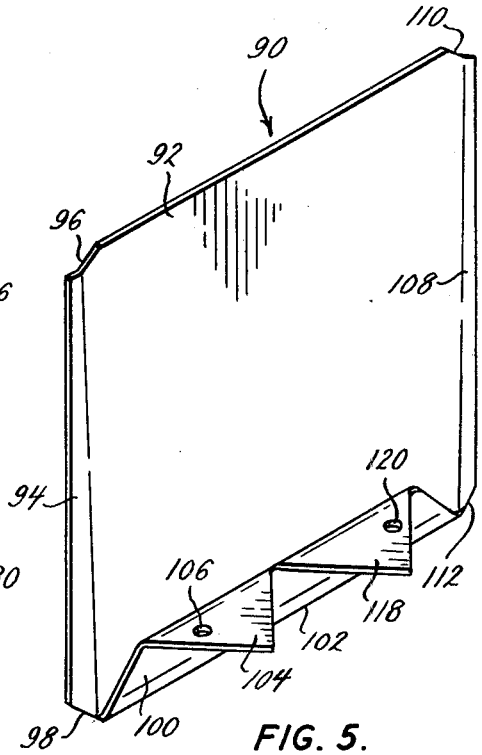
FIG. 5.

FASCIA-PROTECTING DRIP-DIVERTING DEVICE

BACKGROUND AND FIELD OF THE INVENTION

Gutters are customarily mounted adjacent fascia and, if they are water tight, will effectively keep drips of water from reaching that fascia. Unfortunately, the joints between adjacent sections of gutters and between the corners and adjacent sections of the gutters tend to develop leaks. Where those joints leak, water can drip from them and reach the adjacent fascia. Those drips of water can, with the passage of time, adversely affect the paint on the fascia and can, over considerable periods of time, cause the fascia to rot.

SUMMARY OF THE INVENTION

The present invention provides a fascia-protecting drip-diverting device which has an upper portion that can be telescoped upwardly into the space between a fascia and a gutter which is disposed immediately adjacent that fascia, has a lower portion which is thicker, stiffer and stronger than that upper portion to enable that lower portion to withstand the forces which must be applied to that fascia-protecting drip-diverting device to cause that upper portion to telescope into the space between that fascia and that gutter, and has a stop which limits the extent to which that upper portion can be telescoped into the space between that fascia and that gutter. The fascia-protecting drip-diverting device is dimensioned so the bottom thereof is disposed below the level of the bottom of the fascia to cause drips to move downwardly below the level of, and then fall away from, the bottom of the fascia without engaging the fascia. The upper portion of the fascia-protecting drip-diverting device is thin enough so it can be forced up into the space between the fascia and the gutter after the gutter has been installed immediately adjacent the fascia. Once it has been installed, the fascia-protecting drip-diverting device will intercept any drips of water which otherwise would engage the fascia and cause those drips to move downwardly below the level of, and then fall away from, the bottom of the fascia without engaging the fascia. It is, therefore, an object of the present invention to provide a fascia-protecting drip-diverting device which has an upper portion that can be telescoped upwardly into the space between a fascia and a gutter, which has a lower portion that is thicker, stiffer and stronger than said upper portion, which has a stop that limits the extent to which the upper portion can be telescoped into the space between the fascia and the gutter, and which is dimensioned so the bottom of said lower portion is disposed below the level of the bottom of the fascia.

The fascia-protecting drip-diverting device of the present invention has a surface which is imperforate and which is impervious to drips of water and the stop is displaced from that surface. As a result, drips of water which engage the surface will pass downwardly to, and then fall from, the bottom without engaging the stop. As a result, the stop and any fasteners which are used to secure the stop in position, will be protected from drips of water. It is, therefore, an object of the present invention to provide a fascia-protecting drip-diverting device which has an imperforate drip-impervious surface and which has a stop that is displaced therefrom so that the surface can cause drips to pass downwardly to, and then fall from, the bottom of the surface without engaging that stop or any fasteners associated with the stop.

The fascia-protecting drip-diverting device of the present invention has flanges at the side edges thereof which displace those side edges forwardly of, and away from, the fascia. As a result, any drips of water which, due to the inclination of the gutter relative to the horizontal, laterally-directed wind, or for any other reason, tend to move laterally across the front face of the fascia-protecting drip-diverting device will be forced to move outwardly and away from the fascia as they reach the edges of the device. Those drips will then move downwardly along those flanges until they reach the bottom of the fascia-protecting drip-diverting device and then fall away without ever contacting the fascia. It is, therefore, an object of the present invention to provide a fascia-protecting, drip-diverting device which has flanges adjacent the side edges thereof that are displaced outwardly of the fascia to keep laterally-moving drips of water from reaching the fascia.

Other and further objects and advantages of the present invention should become apparent from an examination of the drawing and accompanying description.

In the drawing and accompanying description several preferred embodiments of the present invention are shown and described but it is to be understood that the drawing and accompanying description are for the purpose of illustration only and do not limit the invention and that the invention will be defined by the appended claims.

DESCRIPTION OF THE DRAWINGS

FIG. 1 is a perspective view of one preferred embodiment of fascia-protecting drip-diverting device which is made in accordance with the principles and teachings of the present invention, FIG. 2 is a sectional view through the device of FIG. 1, and it is taken along the plane indicated by the line 2—2 in FIG. 1, FIG. 3 is another sectional view through the device of FIG. 1, and it is taken along the plane indicated by the line 3—3 in FIG. 1, FIG. 4 is a perspective view of a second preferred embodiment of fascia-protecting drip-diverting device which is made in accordance with the principles and teachings of the present invention, FIG. 5 is a perspective view of a third preferred embodiment of fascia-protecting drip-diverting device which is made in accordance with the principles and teachings of the present invention.

DESCRIPTION OF THE PREFERRED EMBODIMENT

Figure 6:
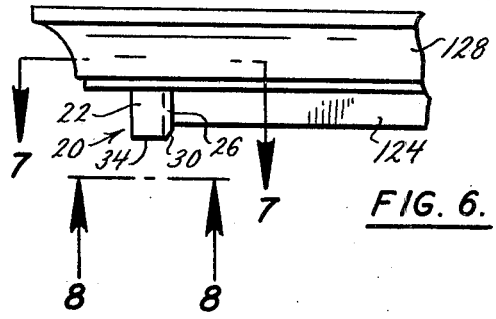
FIG. 6 is a side elevational view of the fascia-protecting drip-diverting device of FIGS. 1-3 as that device is installed between a fascia and the adjacent gutter.

Referring to the drawing in detail, the numeral 20 generally denotes one preferred embodiment of fascia-protecting drip-diverting device which is made in accordance with the principles and teachings of the present invention, and that device is shown as being essentially L-shaped in configuration. The device 20 has a front surface 22, a rear surface 24, a flange 26 adjacent one edge thereof, a cut-away portion 28 at the top of that side edge, and a cut-away portion 30 at the bottom of that side edge. The flange 26 is inclined to the plane of the adjacent portion of device 20, as indicated particularly by FIGS. 2 and 3. As indicated by FIGS. 1–3, that flange is wider at the bottom thereof than it is at the top thereof, and hence the lower portion of that flange is displaced further from the plane of the adjacent portion of the device 20 than is the upper portion of that flange.

The numeral 32 denotes a part of the lower section of the left-hand half of the device 20 which has been bent upwardly and into intimate engagement with the adjacent portion of that half to define a re-entrant bend 34. The re-entrant bend is hollow and somewhat tubular to give it resistance to any forces which were applied to it and which did not lie in the plane of that one-half of the device 20. The portion 32 will coact with the adjacent portion of that one-half of the device 20 and also with the re-entrant bend 34 to constitute a part of that device which is thicker, stiffer and stronger than the upper part of that device. The numeral 36 denotes an extension of the portion 32 which is bent outwardly from the plane of that portion. The portion 36 will act as part of a stop for the device 20. A fastener-receiving opening 38 is formed in the portion 36, as shown particularly by FIG. 1.

The numeral 40 denotes a flange adjacent the opposite side edge of the device 20, and a cut-away portion 42 is adjacent the top of that flange and a cut-away portion 44 is adjacent the bottom of that flange. As shown particularly by FIGS. 2 and 3, the flange 40 is bent outwardly of the plane of the adjacent portion of that device. As shown by FIGS. 1–3, the flange is narrower at the top thereof than it is at the bottom thereof. The flange 40 is similar to the flange 26, and both of those flanges are essentially vertically directed.

The numeral 46 denotes a part of the lower area of the right-hand side of the device 20 which is bent back against the adjacent portion of that right-hand half to define a re-entrant bend 48. The portion 46 and the re-entrant bend 48 are essentially identical to the portion 32 and the re-entrant bend 34 at the lower end of the lefthand portion of the device 20. Further, the portion 46 and the re-entrant bend 48 perform the same function which the portion 32 and the re-entrant bend 34 perform. The numeral 50 denotes an extension of the portion 46 which has been bent at an angle to that portion; and that extension constitutes the rest of the stop of which 36 is the first part. As indicated particularly by FIG. 1, the confronting edges of the extensions 36 and 50 are immediately adjacent each other. A fastener-receiving opening 52 is provided in the extension 52.

Figure 8:
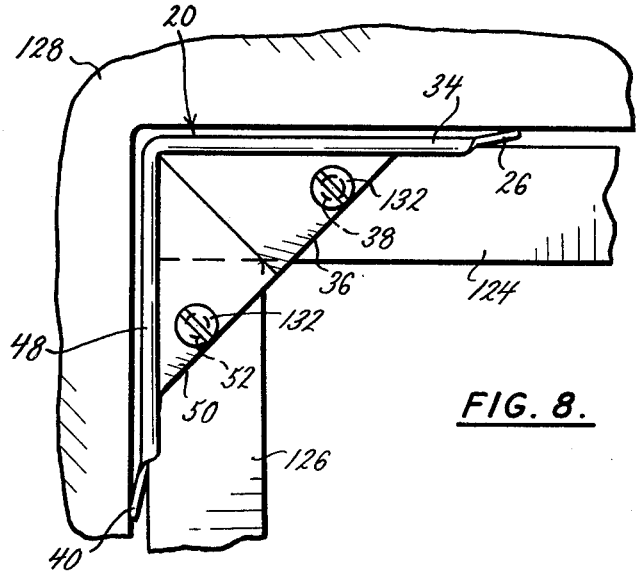
FIG. 8 is a bottom view of the fascia-protecting drip-diverting device shown in FIG. 6.

The fastener-receiving opening 38 and 52 should be displaced a substantial distance from the apex of the ninety-degree angle subtended by the two halves of the device 20. That displacement enables any fasteners which are passed through those openings to be displaced from the ends of the boards which constitute the fascia even though those boards are disposed in butting engagement, as indicated by FIG. 8.

The fascia-protecting drip-diverting device 20 could be made of different materials and could be made in different ways. However, that device preferably is made from a metal which is sturdy, which will not rust or corrode, and which will not interact with a metal gutter to develop a galvanic action. One such metal is stainless steel. That device preferably is made by punching and forming operations.

The fascia-protecting drip-diverting device 20 is used adjacent the corners of gutters where the external angle subtended by the boards of the fascia is two hundred and seventy degrees. To install the device 20, it is only necessary to dispose the rear face 24 in engagement with the outer faces of the portions of the fascia board which define the corner for the fascia and to urge the top edge of that device upwardly into the narrow space between those boards and the adjacent faces of the gutter. The cut-away portion 28 and 42 will facilitate the insertion of that top edge into that space and also will facilitate the movement of that top edge upwardly through that space. Further, the narrow upper portions of the flanges 26 and 40 will facilitate the movement of the upper edge of the device upwardly through the space between the fascia boards and the gutter.

If, as usually will be the case, the space between the fascia boards and the gutter is so narrow that an installer cannot fully seat the device 20 with its stop 36, 50 in engagement with the lower edges of the fascia boards, that installer can use a hammer to apply upwardly-directed forces to the re-entrant bends 34 and 48. Those re-entrant bends will be sturdy enough to resist blows which are truly vertically directed and also will be able to resist blows which are inclined to the vertical.

The stop 36, 50 will be visible to the installer as he is forcing the device 20 up into position between the fascia and the gutter, and hence he can readily recognize when the stop abuts the lower edges of the fascia boards. At such time, the installer should use a small drill bit to form small openings within the fascia boards in register with the fastener-receiving openings 38 and 52 in the stop 36, 50. Small wood screws such as the wood screws 132 in FIG. 8 can then be passed upwardly through the openings 38 and 52 in the stop 36, 50 and seated in those small openings. At this time, the fascia and the gutter will provide full support for the upper portion of the fascia-protecting drip-diverting device and the stop 36, 50 and the wood screws 132 will be providing full support for the bottom of that device. Consequently, that device will be held solidly in position even though the gutter will expand and contract with changes in temperature and even though the boards of the fascia may swell and contract with changes in humidity.

It will be noted that the front surface 22 of the device 20 is imperforate and also is impervious to water. Further, it will be noted that the stop 36, 50 is displaced wholly away from surface 22 and, additionally, is displaced upwardly above the level of the bottom of that surface. As a result, any drips which engage the front surface 22 will be guided downwardly below the level of the stop 36, 50 and will be caused to fall away from the bottom edge of the surface 22 without ever contacting that stop. Moreover, it should be noted that any drips which reach the surface 22 will be guided downwardly below the bottom edge of the fascia and will be caused to fall from the bottom of that surface without ever reaching that fascia. Where drips tend to move laterally of the surface 22, because of the inclination of the gutter or because of laterally-directed winds, any drips which reach the flange 26 or the flange 40 will be forced, by one or the other of those flanges, to move outwardly and away from the adjacent fascia. As a result, instead of moving into engagement with, and clinging to, the fascia, those drips will be caused to work their way downwardly along the flange 26 or 40 until they reach the cut-away portion 30 or 44 and then will move down to and fall away from the re-entrant bend 34 or 48. In this simple, automatic, and unerring way, the device 20 will protect the fascia by diverting drips away from it and causing them to fall downwardly without ever contacting the fascia.

Referring particularly to FIG. 4, the numeral 56 generally denotes a second preferred embodiment of fascia-protecting drip-diverting device which is made in accordance with the principles and teachings of the present invention. That device is shown as being L-shaped in configuration, and it has a front surface 58 and a rear surface 60. A flange 62 is provided at one side edge of that device and a flange 76 is provided at the opposite side edge of that device. Those flanges are similar to the flanges 26 and 40 on the device 20, but the inclinations thereof are opposite to the inclinations of the flanges 26 and 40. Specifically, the flanges 62 and 76 incline inwardly of the ninety-degree angle subtended by the two halves of device 56 whereas the flanges 26 and 40 of the device 20 incline outwardly from the ninety degree angle subtended by the two halves of that device. Cut-away portions 64 and 66 are provided at the upper and lower end, respectively, of the flange 62, and cut-away portions 78 and 80 are provided at the upper and lower ends, respectively, of the flange 76. As indicated by FIG. 4, the upper portions of the flanges 62 and 76 are narrower than the lower portions of those flanges.

The numerals 68 and 82 denote part of the lower area of the device 56 which have been bent upwardly and into engagement with the adjacent portions of that device. Those portions generally resemble the portions 32 and 46 of the device 20; but the portion 68 and 82 are bent outwardly from the ninety degree angle subtended by the halves of the device 56 whereas the portions 32 and 46 are bent inwardly of the ninety degree angle subtended by the halves of the device 20. The portions 68 and 82 coact with the adjacent portions of the halves of the device 56 to define re-entrant bends 70 and 84 which are similar to, and which will perform the functions performed by the re-entrant bends 34 and 48 of the device 20. Extensions 72 and 86 of the portions 68 and 82, respectively, constitute the two parts of the stop for the device 56. That stop will perform the functions performed by the stop 36, 50 of device 20, but that stop is disposed exteriorly of the ninety degree angle subtended by the halves of the device 56 whereas the stop 36, 50 is disposed interiorly of the ninety degree angle subtended by the halves of the device 20. Fastener-receiving openings 74 and 88 are provided in that stop.

The device 56 is intended for use with those portions of gutters which are referred to as interior corners whereas the device 20 is used with those portions of gutters which are referred to as exterior corners. To install the device 56, the upper edge of the rear face 58 will be placed in engagement with the interior corner defined by the fascia and then moved upwardly into the narrow space between that fascia and the adjacent gutter. If, as usually will be the case, the installer is unable to urge the device 56 far enough to that space to fully seat that device, the installer can use a hammer to apply blows to the re-entrant bends 70 and 84 which will force that device to move upwardly into its fully-seated position. The stop 72, 86 will be visible to the installer as the device 56 is being moved up into its fully-seated position, and hence the installer will know when that stop has engaged the lower edges of the fascia board. At such time, a small drill bit should be used to form openings in the fascia boards in register with the fastener-receiving opening 74 and 88. Thereafter, wood screws, such as the wood screws 132 of FIG. 8, can be passed upwardly through those fastener-receiving openings and seated in the wood of the fascia. At this time, the upper portion of the device 56 will be solidly held and supported by the fascia and by the gutter, and the bottom of that device will be held by the screws 132 and the stop 72,86. Consequently, that device will be held in position despite expansions and contractions of the gutter and swellings and contractions of the fascia.

The device 56 will operate in the same manner in which the device 20 operates. Specifically, it will intercept any drips from the interior corner of the gutter which tends to reach the fascia—whether those drips tend to move vertically downwardly or tend to move laterally—and will force those drips to move downwardly to the lower edges of the surface 60 without ever reaching that fascia or the stop 72,86. Even where the drips tend to move laterally of the surface 60, due to the inclination of the gutter or to laterally-directed winds, the flange 62 or the flange 76 will force those drips to move outwardly and away from the fascia so that they will move downwardly to, and drop away from, the lower edges of those flanges rather than reach the fascia. In this way, the device 56 will automatically, simply and unerringly protect the fascia and the stop 72, 86 from being contacted by any drips.

Referring particularly to FIG. 5, the numeral 90 generally denotes a third preferred embodiment of fascia-protecting drip-diverting device which is made in accordance with the principles and teachings of the present invention. That device differs from the devices 20 and 56 in being essentially planar. The rear surface of that device is denoted by the numeral 92, and flanges 94 and 108 at the side edges of that device incline forwardly from the plane defined by that rear surface. Cut-away portions 96 and 98 are provided adjacent the upper and lower ends, respectively, of the flange 94, and cut-away portions 110 and 112 are provided at the upper and lower ends, respectively, of the flange 108. As indicated particularly by FIG. 5, the upper ends of the flanges 94 and 108 are narrower than are the lower ends of those flanges. The lower part 100 of the device 90 is bent back up into engagement with the adjacent portion of the rear surface 92 to define a re-entrant bend 102. Re-entrant bend 102, like the re-entrant bends of the devices 20 and 56 is hollow and has a generally tubular configuration. Re-entrant bend 102 will be similar to, and will perform the functions of the re-entrant bends of the devices 20 and 56. Extensions 104 and 118 of the upwardly bent portion 100 constitute the stop for the device 90, and that stop projects outwardly from the rear surface 92 of that device. Fastener-receiving openings 106 and 120 are provided in the extensions 104 and 118.

The device 90 will be used between planar portions of the fascia and the adjacent gutter. The function and operation of that device are so similar to those of the devices 20 and 56 as to require no further explanation.

Figure 7:
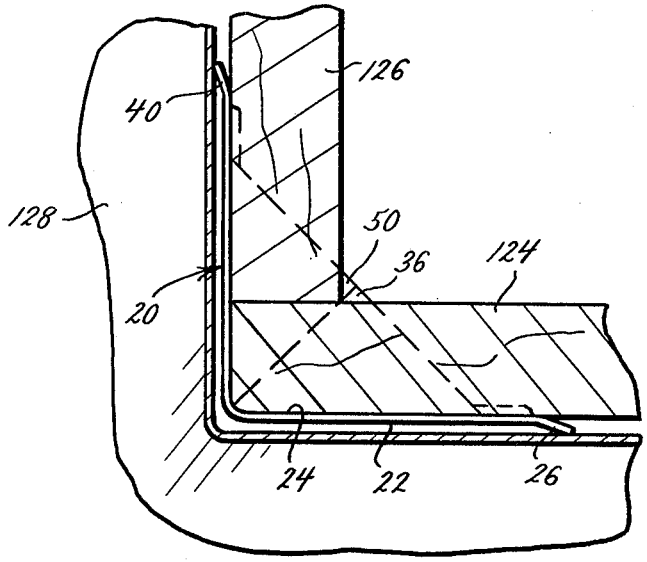
FIG. 7 is a sectional view, on a larger scale, through the fascia-protecting drip-diverting device shown in FIG. 6, and it is taken along the plane indicated by the line 7—7 in FIG. 6.

Referring particularly to FIGS. 7 and 8, the numerals 124 and 126 denote fascia boards which define an exterior corner, and the numeral 128 denotes a gutter which is mounted immediately adjacent those fascia boards. FIGS. 7 and 8 show the device 20 interposed between the gutter 128 and the fascia boards 124 and 126. The flanges 26 and 40 have their edges in engagement with the inner surface of the gutter and, more importantly, have those edges displaced outwardly from the fascia boards 124 and 126. Because the widths of those flanges progressively increase, from the upper to the lower ends thereof, those portions of the flanges which are at the lower edge of the gutter and below will be displaced even further from the faces of the fascia boards than are those portions of those flanges which are hidden by the gutter. The angles at which the flanges of the various fascia-protecting drip-diverting devices are displaced from the planes of the adjacent portions of those devices should be large enough to displace the edges of those flanges far enough away from the faces of the fascia board to keep drips from reaching those fascia boards but should be small enough to keep those flanges from preventing the telescoping of those devices up into the space between the fascia and the gutter. Also, the angle is made large enough so it will have to be flattened out somewhat as the fascia-protecting drip-diverting device is driven up into its fully-seated position. This is important because that flattening out will develop restorative forces within the devices which will hold the edges of those flanges in engagement with the inner portion of the bottom of the gutter. The resulting intimate contact will continue despite expansion and contraction of the gutter and despite swelling or contraction of the fascia and will make sure that no drip could move laterally along that inner bottom edge of the gutter and not be intercepted by one or the other of the flanges. If both flanges were not continuously in engagement with the inner bottom edge of the gutter, some laterally-moving drips could move past those flanges and eventually reach the fascia and cling to it. Although the angle at which the flanges are displaced from the planes of the adjacent portions of the fascia-protecting drip-diverting devices are not critical, they must be greater than ten degrees and very substantially less than ninety degrees. Angles in the range of ten to thirty degrees would be usable.

The hollow somewhat-tubular nature of the re-entrant bends at the lower edges of the fascia-protecting drip-diverting devices are not only useful in helping those devices withstand upwardly-directed and inclined blows, but also are useful in the event the fascia-protecting drip-diverting devices were to be removed during the re-painting of the fascia. Those hollow, somewhat-tubular configurations would facilitate the gripping of the lower edges of those devices with a pair of pliers and the application of sufficient downwardly-directed forces to free those devices from the frictional forces applied to them by the fascia and the adjacent gutter.

Whereas the drawing and accompanying description have shown several preferred embodiments of the present invention, it should be apparent to those skilled in the art that various changes may be made in the form of the invention without affecting the scope thereof.

What I claim is:

1. A fascia-protecting, drip-diverting device which has an upper portion, a lower portion, and a stop, said upper portion being thin so it is adapted to be telescoped upwardly into the narrow space between a fascia and a gutter which is disposed immediately adjacent said fascia, said lower portion being thicker, stiffer and stronger than said upper portion so it is adapted to withstand the forces which must be applied to said fascia-protecting drip-diverting device to cause said upper portion to telescope upwardly into said narrow space between said fascia and said gutter, said stop being adapted to limit the extent to which said upper portion is telescoped upwardly into said narrow space between said fascia and said gutter, said fascia-protecting drip-diverting device being dimensioned so the bottom of said lower portion is disposed below the level of the bottom of said fascia when said stop limits the extent to which said upper portion is telescoped upwardly into said narrow space between said fascia and said gutter, whereby said bottom of said lower portion is adapted to cause drips to move downwardly below the level of, and then fall away from, said bottom of said fascia without engaging said fascia.

2. A fascia-protecting drip-diverting device as claimed in claim 1 wherein said lower portion has a part thereof which is bent back toward the rest of said lower portion to form a re-entrant bend which defines said bottom of said lower portion, and wherein said re-entrant bend is hollow.

3. A fascia-protecting drip-diverting device as claimed in claim 1 wherein said stop is adapted to underlie and abut said bottom of said fascia.

4. A fascia-protecting drip-diverting device as claimed in claim 1 wherein said stop is located above the level of said bottom of said lower portion.

5. A fascia-protecting drip-diverting device as claimed in claim 1 wherein said stop is adapted to underlie and abut said bottom of said fascia and wherein said stop has fastener-receiving openings therein.

6. A fascia-protecting drip-diverting device as claimed in claim 1 wherein said stop is adapted to underlie and abut said bottom of said fascia, and wherein said stop is located above the level of said bottom of said lower portion.

7. A fascia-protecting drip-diverting device as claimed in claim 1 wherein said stop is adapted to underlie and abut said bottom of said fascia, wherein said stop is located above the level of said bottom of said lower portion, and wherein said stop has fastener-receiving openings therein.

8. A fascia-protecting drip-diverting device as claimed in claim 1 wherein said lower portion has a part thereof which is bent back toward the rest of said lower portion to form a re-entrant bend which defines said bottom of said lower portion, and wherein said stop is part of, and projects outwardly from, said bent part of said lower portion.

9. A fascia-protecting drip-diverting device as claimed in claim 1 wherein said stop is adapted to underlie and abut said bottom of said fascia, wherein said stop is located above the level of said bottom of said lower portion, wherein said stop has fastener-receiving openings therein, wherein said lower portion has a part thereof which is bent back toward the rest of said lower portion to form a re-entrant bend which defines said bottom of said lower portion, and wherein said stop is part of and projects outwardly from said bent part of said lower portion.

10. A fascia-protecting drip-diverting device which has an upper portion, a lower portion, side edges, a rear surface, and a front surface, said upper portion being thin so it is adapted to be telescoped upwardly into the narrow space between a fascia and a gutter which is disposed immediately adjacent said fascia, said side edges inclining forwardly relative to said rear surface to coact with said front surface to subtend obtuse angles, the forward inclinations of said side edges displacing said side edges forwardly of, and away from, said fascia, so drips which tend to move laterally of said fascia-protecting drip-diverting device will be forced to move forwardly and away from said fascia as they reach said side edges.

11. A fascia-protecting drip-diverting device as claimed in claim 10 wherein the bottoms of said side edges are displaced further forwardly of said fascia than are the tops of said side edges.

12. A fascia-protecting drip-diverting device which has an upper portion, a lower portion, and a securing portion, said upper portion being thin to be telescoped upwardly into the narrow spaced between a fascia and a gutter which is disposed immediately adjacent said fascia, said securing portion being adjacent said lower portion, said upper portion coacting with said fascia and gutter to support and confine the top of said fascia-protecting drip-diverting device, and said securing portion coacting with said fascia to support and confine the bottom of said fascia-protecting drip-diverting device, whereby said fascia-protecting drip-diverting device has two vertically-disposed points of support.

13. A fascia-protecting drip-diverting device which has a surface with one part thereof disposable between a fascia and a gutter which is immediately adjacent that fascia and with a further part that will depend downwardly below the level of the bottom of said gutter to overlie a portion of the lower face of said fascia and with a still further part that will depend downwardly below the level of the bottom of said fascia, and a stop, said further part of said surface being imperforate and also being impervious to drips, and said stop being displaced from said further part and also from said still further part of said surface to be out of the path of drips.

14. A fascia-protecting drip-diverting device as claimed in claim 13 wherein said surface is at the front of said fascia-protecting drip-diverting device, wherein said stop is at the rear of said fascia-protecting drip-diverting device, and wherein said stop is disposed above the level of the bottom of said still further part of said surface.

15. A fascia-protecting drip-diverting device as claimed in claim 13 wherein said stop is accessible to a workman when the first said part of said surface is between said gutter and said fascia, and wherein said stop has fastener-receiving openings therein through which said workman can pass fasteners to secure said stop, and hence said fascia-protecting drip-diverting device, to said fascia.

16. The combination of a fascia, a gutter disposed immediately adjacent said fascia, and a fascia-protecting drip-diverting device which has an upper portion, a lower portion, and a stop, said upper portion being thin so it is adapted to be telescoped upwardly into the narrow space between said fascia and said gutter, said lower portion being thicker, stiffer and stronger than said upper portion so it is adapted to withstand the forces which must be applied to said fascia-protecting drip-diverting device to cause said upper portion to telescope upwardly into said narrow space between said fascia and said gutter, said stop being adapted to limit the extent to which said upper portion is telescoped upwardly into said narrow space between said fascia and said gutter, said fascia-protecting drip-diverting device being dimensioned so the bottom of said portion is disposed below the level of the bottom of said fascia when said stop limits the extent to which said upper portion is telescoped upwardly into said narrow space between said fascia and said gutter, whereby said bottom of said lower portion is adapted to cause drips to move downwardly below the level of, and then fall away from, said bottom of said fascia without engaging said fascia.

* * * * *